US010569438B2

(12) United States Patent
Bagley et al.

(10) Patent No.: US 10,569,438 B2
(45) Date of Patent: Feb. 25, 2020

(54) SPIRAL SLICER

(71) Applicant: Progressive International Corporation, Kent, WA (US)

(72) Inventors: Justin Bagley, Seattle, WA (US); Jennifer K. Cotter, Seattle, WA (US)

(73) Assignee: Progressive International Corporation, Kent ( * ) Notice: Subject to any disclaimer, the term of this patent is extended or adjusted under 35 U.S.C. 154(b) by 36 days.

(21) Appl. No.: 15/396,176

(22) Filed: Dec. 30, 2016

(65) Prior Publication Data

US 2017/0136644 A1 May 18, 2017

Related U.S. Application Data

(63) Continuation of application No. 15/354,748, filed on Nov. 17, 2016, now Pat. No. 10,183,409.

(60) Provisional application No. 62/257,119, filed on Nov. 18, 2015.

(51) Int. Cl.

| | |
|---|---|
| ***B26D 3/11*** | (2006.01) |
| ***B26D 7/26*** | (2006.01) |
| ***B26D 1/03*** | (2006.01) |
| ***B26D 3/26*** | (2006.01) |
| ***B26D 3/28*** | (2006.01) |
| ***B26D 7/06*** | (2006.01) |

(52) U.S. Cl.

CPC ..... *B26D 3/11* (2013.01); *B26D 1/03* (2013.01); *B26D 3/26* (2013.01); *B26D 3/283* (2013.01); *B26D 7/0666* (2013.01); *B26D 7/26* (2013.01); *B26D 2003/286* (2013.01); *B26D 2003/288* (2013.01); *B26D 2210/02* (2013.01); *Y10T 83/6667* (2015.04); *Y10T 83/9493* (2015.04)

(58) Field of Classification Search

CPC ..... B26D 3/11; B26D 3/26; B26D 2003/288; B26D 7/0666; A47J 17/16; A47J 17/02; Y10Y 83/6667; Y10T 83/6667; Y10T 83/9394

USPC ..... 83/733; 99/537

See application file for complete search history.

(56) References Cited

U.S. PATENT DOCUMENTS

| | | | | |
|---|---|---|---|---|
| D254,590 | S * | 4/1980 | Doyel | 83/733 |
| 2010/0281696 | A1* | 11/2010 | Hao | B26B 5/001 30/152 |
| 2015/0375414 | A1* | 12/2015 | Wong | B26D 3/283 83/699.61 |
| 2017/0305028 | A1* | 10/2017 | Zhang | B26D 7/2628 |

* cited by examiner

*Primary Examiner* — Laura M Lee

(74) *Attorney, Agent, or Firm* — Lowe Graham Jones PLLC

(57) ABSTRACT

A spiral slicer for producing spiral-cut fruits and vegetables, includes a main body supporting a shaft operated by a crank handle. Rotation of the crank handle selectively moves a pusher, which attaches to a fruit or vegetable toward a set of julienne blades and a main slicing blade. The fruit or vegetable is cut by the julienne blades and then by the main blade, with the sliced portion passing through a gap positioned between the julienne blades and the main blade.

13 Claims, 11 Drawing Sheets

SPIRAL SLICER

PRIORITY CLAIM

This application is a continuation of U.S. application Ser. No. 15/354,748 filed Nov. 17, 2016, which claims the benefit of U.S. provisional application No. 62/257,119, filed Nov. 18, 2015, the contents of each of which are incorporated by reference.

FIELD OF THE INVENTION

This invention generally relates to devices for producing a spiral-cut fruit or vegetable.

BACKGROUND OF THE INVENTION

A spiral cutting tool is useful for creating strips of fruits or vegetables, such as potatoes, that are shaped in curls or spirals. Existing devices can be inconvenient to use, however, and lack the ability to readily reconfigure the cutting device for different widths of spiral-cut strips, or to use the device for grating as well as spiral cutting.

SUMMARY OF THE INVENTION

A spiral slicer for producing spiral-cut fruits and vegetables, includes a main body supporting a shaft operated by a crank handle. Rotation of the crank handle selectively moves a pusher, which attaches to a fruit or vegetable (such as a potato, for example), toward a set of julienne blades and a main slicing blade. The fruit or vegetable is cut by the julienne blades and then by the main blade, with the sliced portion passing through a gap positioned between the julienne blades and the main blade. As a result, spiral-cut strips of vegetable are produced by the rotation of the crank handle.

In a preferred version, the main body supports a julienne blade holder which is configured to support more than one set of julienne blades. The julienne blade holder can be positioned as desired to enable a desired set of julienne blades to be positioned in the path of the rotating fruit or vegetable. A blade lock maintains the julienne blade holder in a desired position.

In one example, a main body has a slicing end and a crank end, with a central body portion joining the slicing end to the crank end, the main body being configured to support the spiral slicer on a horizontal surface. A shaft is attached to the crank end of the main body, the shaft having a pusher at a first end of the shaft and a crank handle at an opposing second end of the shaft, the crank handle being operable to urge the shaft and the pusher toward the slicing end of the main body.

In a preferred version, a main slicing blade attached to the slicing end of the main body, and a julienne blade holder is mounted to the slicing end of the main body, the julienne blade holder having a first plurality of julienne slicing blades and a second plurality of julienne slicing blades and being positioned adjacent the main slicing blade with a gap between the julienne blade holder and the main slicing blade.

In one version, the julienne blade holder is mounted for rotational movement about an axis into at least a first rotational position and a second rotational position, wherein in the first rotational position the first plurality of julienne blades faces toward the crank end of the main body to encounter a food item urged toward the main blade by the pusher, and in the second rotational position the second plurality of julienne blades faces toward the crank end of the main body to encounter a food item urged toward the main blade by the pusher.

In an example of the invention, the slicer includes a blade lock which may be attached to the slicing end of the main body to selectively lock the julienne blade holder in either the first rotational position or the second rotational position, or to unlock the julienne blade holder for movement between the first rotational position and the second rotational position.

In one version, the julienne blade holder includes a first post and a second post, the first post having a knob, the first post and the second post defining the axis of rotational movement of the julienne blade holder.

In another example, the julienne blade holder and the slicing end of the main body comprise complementary mating surfaces whereby when the complementary mating surfaces are interconnected the julienne blade holder is locked into either the first rotational position or the second rotational position.

The complementary mating surfaces may comprise a plurality of fins formed on the julienne blade holder and a bore positioned in the slicing end of the main housing, the bore having a plurality of radial cutouts which engage the plurality of fins.

The plurality of fins may be formed on the second post, and a coil spring may be carried on the second post and trapped between the julienne blade holder and a support platform positioned on the slicing end of the main body, the bore further being formed in the support platform.

The blade lock in a preferred version is slideably mounted to the slicing end of the main body, the blade lock further having a channel for receiving the first post in a locked position, the blade lock further having an unlocked position in which the bladed lock is moved laterally away from the first post.

The blade lock may also be pivotally mounted to the slicing end of the main body, the blade lock further having a channel for receiving the first post in a locked position, the blade lock further having an unlocked position in which the bladed lock is moved pivotally away from the first post.

The julienne blade holder preferably includes a first face, a second face, and a third face, the first set of julienne blades being positioned on the first face, the second set of julienne blades being positioned on the second face, and the third face being devoid of blades, and further wherein the julienne blade holder is selectively moveable to a third rotational position in which the third face is directed toward the crank end of the main body.

The spiral slicer may also include an alignment tube carried on the slicing end of main body adjacent the main slicing blade and adjacent the julienne blade holder.

In a preferred version, the slicing end and the crank end each extend upwardly from the central body portion.

In an example, a blade guard is positioned over the julienne blade holder, the julienne blade holder being positioned between the blade guard and the crank end.

BRIEF DESCRIPTION OF THE DRAWINGS

Preferred and alternative examples of the present invention are described in detail below with reference to the following drawings.

DETAILED DESCRIPTION OF THE PREFERRED EMBODIMENT

Figure 1:
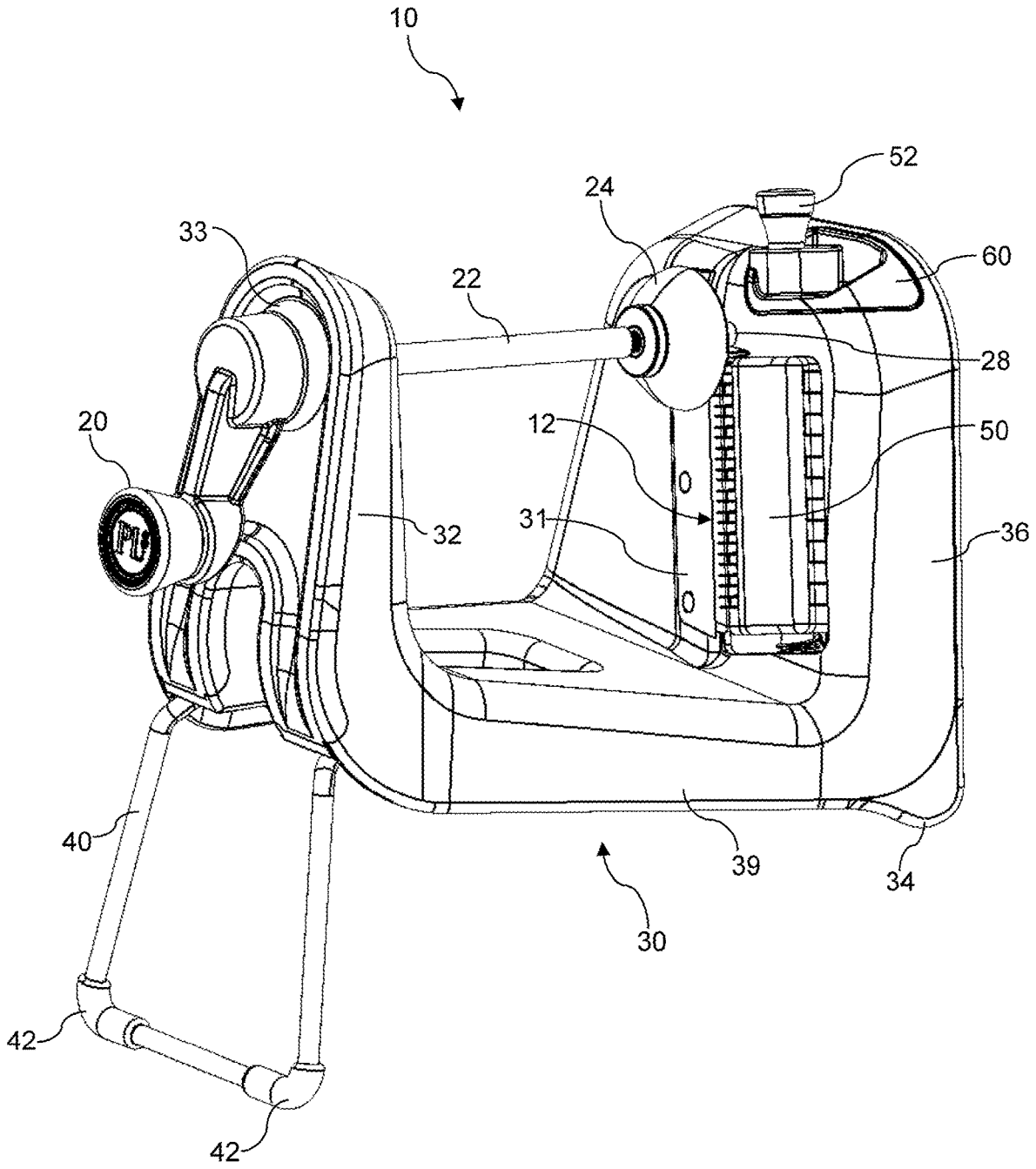
FIG. 1 is a front top perspective view of a preferred spiral cutter.

A preferred spiral cutter 10 is shown in FIG. 1, and in the illustrated version the spiral cutter includes a main body 30 having a crank end 32 separated from a slicing end 36. Most preferably, the slicing end and crank end are upwardly extending portions that are integrally formed with a central body portion which is preferably configured as a substantially horizontal lower body portion 39. As illustrated, the main body is generally formed with a U-shape as viewed from the front, with the crank end and slicing ends forming the uprights of the U, and the lower body portion forming the base of the U and connecting the crank end to the slicing end. In one version, the main body is integrally formed from a generally rigid plastic material such as ABS.

The crank end 32 of the main body includes a mount 33 for receiving a shaft 22. The shaft is preferably threaded along its length such that it is received in a mating threaded mount to allow the shaft to move toward or away from the slicing end 36 of the main body by rotating the shaft within the mount. A crank handle 20 is attached to a first end the shaft to allow the shaft to be rotated and moved toward the slicing end of the main body. A pusher 24 is attached to a second end of the shaft, and in the illustrated example the pusher includes one or more spikes or fins 26, in which the spikes or fins are configured to be able to grasp a vegetable such as a potato. As illustrated, the crank handle and the pusher are positioned on opposite sides of the crank end of the main body while the shaft extends through the crank end of the main body. In some versions, the crank handle, the pusher, or both, may be removable from the shaft to allow the shaft to be fully removed from the mount 33 for cleaning.

Figure 11:
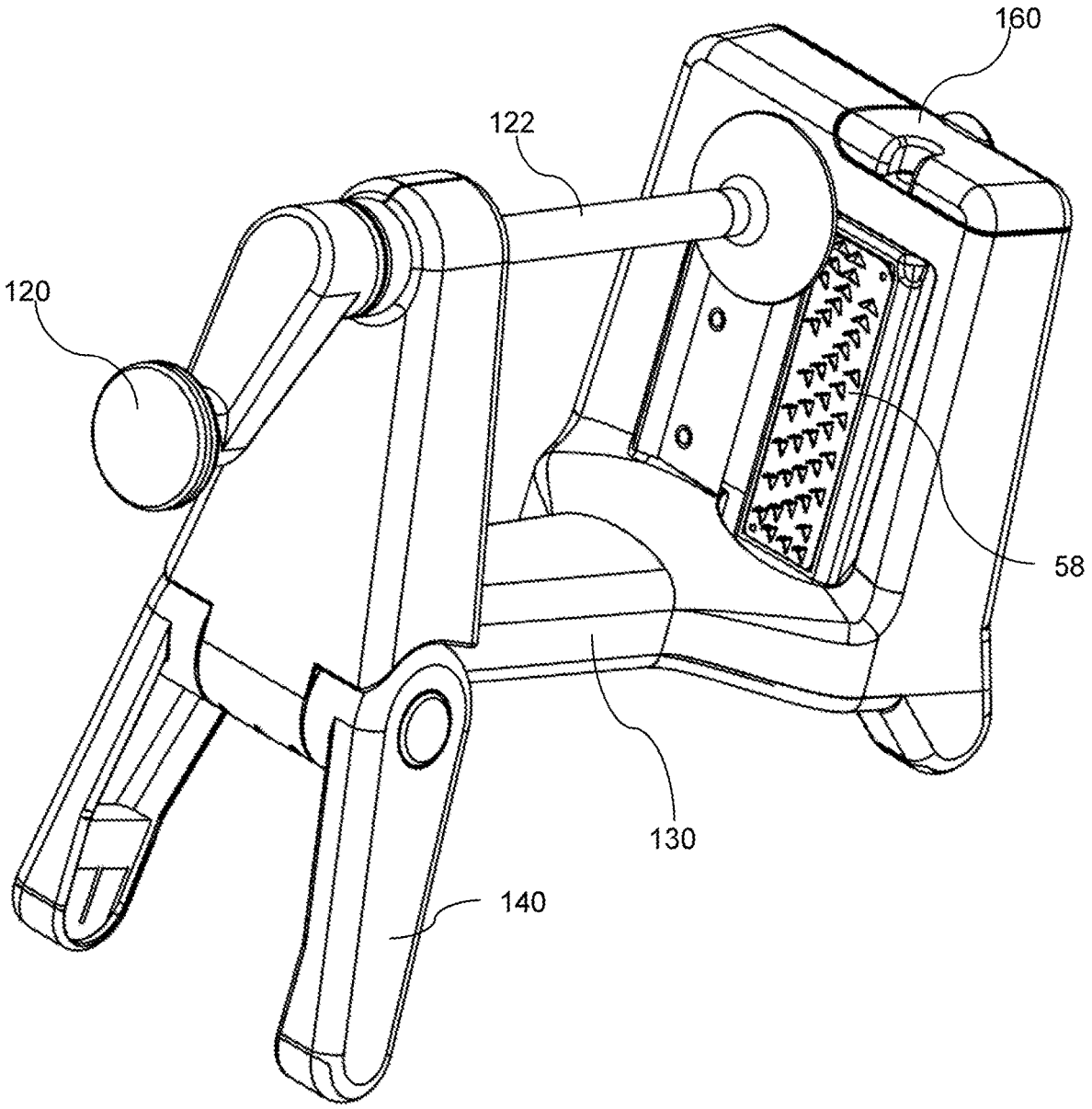
FIG. 11 is a front perspective view of an alternate spiral cutter.

The spiral cutter is preferably configured to be supported on a horizontal surface such as a countertop, and in such a version the cutter includes a lower surface to allow the main body to be supported on a countertop. In the version of FIG. 1, the main body includes a forward stand 40 positioned at the crank end of the main body. The forward stand terminates in lower feet 42. In one example, the stand may be made from stainless steel, with the feet formed from a resilient material such as silicone in order to provide a non-skid surface for the device. A pair of rear feet 34 is provided at the slicing end of the main body, and in the preferred example the rear feet are also formed form a resilient material. As best seen in FIGS. 1 and 11, the stand is taller than the feet 34 such that when the stand 40 (or 140) is deployed the crank end 32 is raised with respect to the slicing end 36, so that the central body portion is inclined from the slicing end to the crank end relative to the horizontal surface on which it rests.

Figure 2:
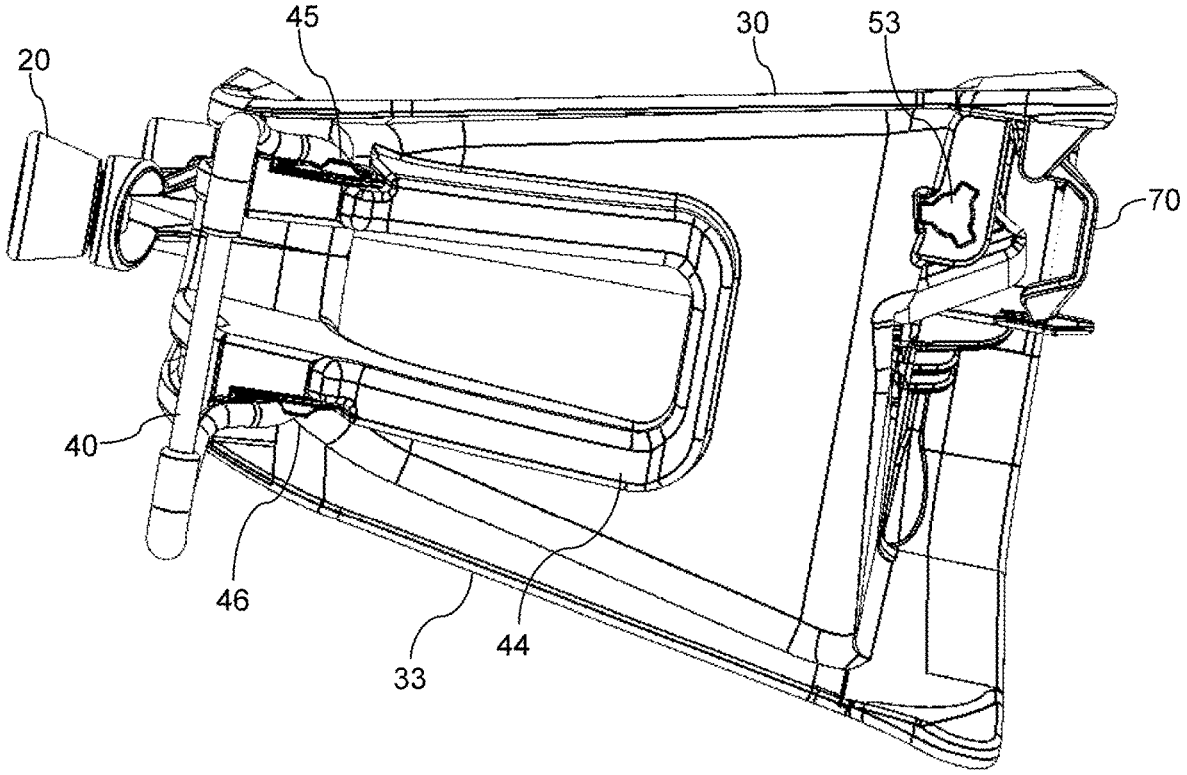
FIG. 2 is a bottom view of a preferred spiral cutter.

In one version, the forward stand is pivotally attached to the main body so that it can be retracted into the main body for more compact storage. As best seen in the bottom view of FIG. 2, the stand 40 may be pivotally attached to the main body at a pair of pivot locations 45, 46, which are preferably configured as holes sized and arranged to receive terminal ends of the stand. The main body may also comprise a peripheral skirt 33 and in interior frame 44, so that the stand is retractable into the space between the skirt and the frame.

As shown in FIG. 1, the cutting end of the main body includes an attached main slicing blade 31, which is preferably attached to the cutting end with a sharpened edge of the blade oriented in a vertical fashion, perpendicular to the horizontal surface on which the spiral cutter may be supported. A julienne blade holder 50 is positioned adjacent the main blade, with a gap 12 provided between the main blade and the julienne blade holder. An alignment tube 28 may be attached to the cutting end of the main body, preferably positioned above the julienne blades and extending toward the crank end of the main body. Preferably, the alignment tube is sized and configured to engage the holder and prevent the holder and its fins from encountering the main slicing blade or julienne blades. The alignment tube may also serve as a spindle for the end of the food item as it is urged toward the blades.

Figure 3:
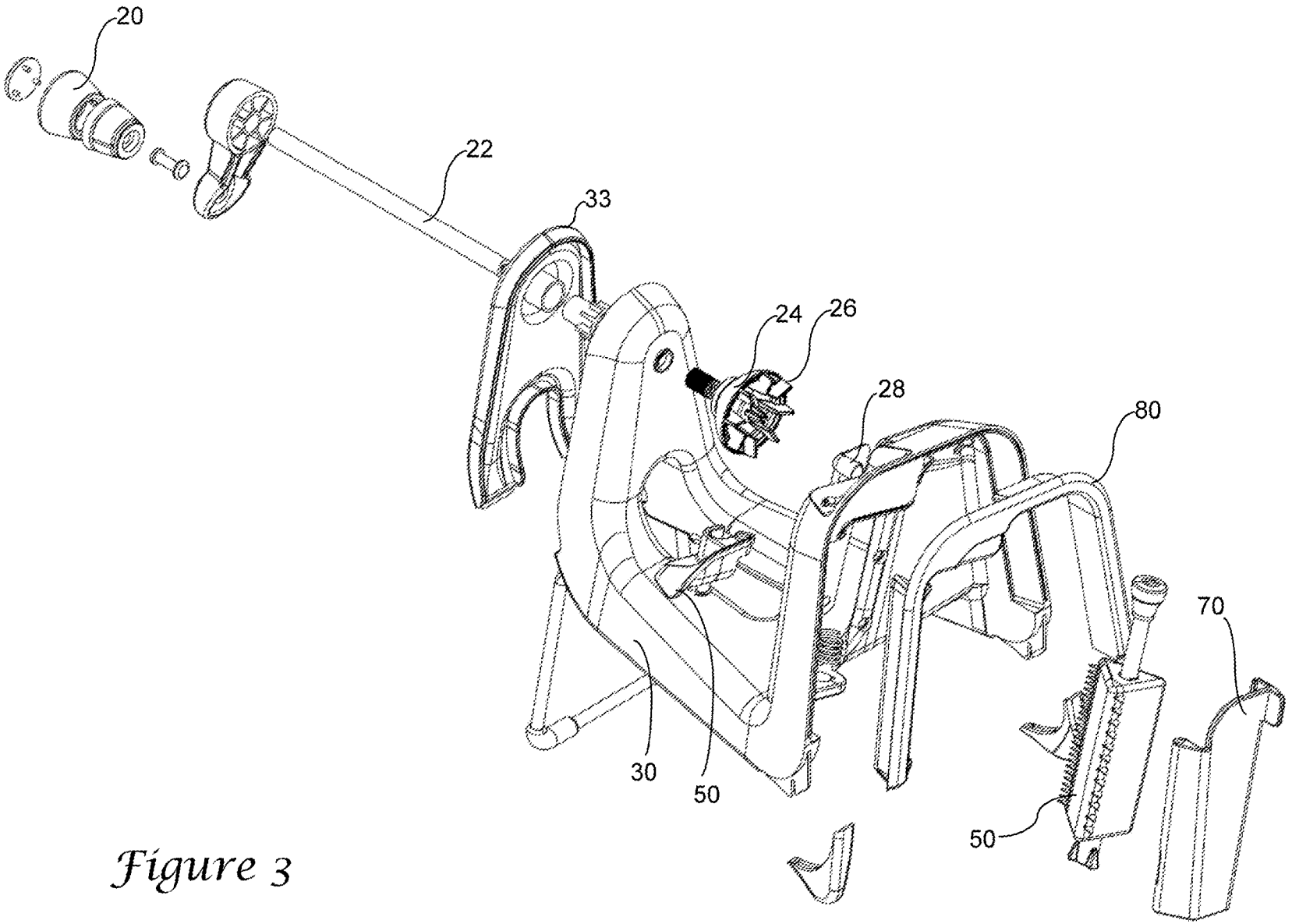
FIG. 3 is a top perspective exploded view of a preferred spiral cutter.

The julienne blade holder is selectively repositionable to allow a user to choose from among a plurality of sets of julienne blades. In the illustrated example, the julienne blade includes a knob 52 positioned at the top of the slicing end of the main body so that the user may grasp the knob and rotate the julienne blade holder to a desired position. A locking cap 60 engages the julienne blade holder to maintain the julienne blade holder in its selected position, as described further below. A blade guard 70 (see FIGS. 2 and 3) covers the main slicing blade and the julienne blades at a rear side of the cutting end of the main body, farthest from the crank end, to prevent a user from being cut by the blades.

Figure 10:
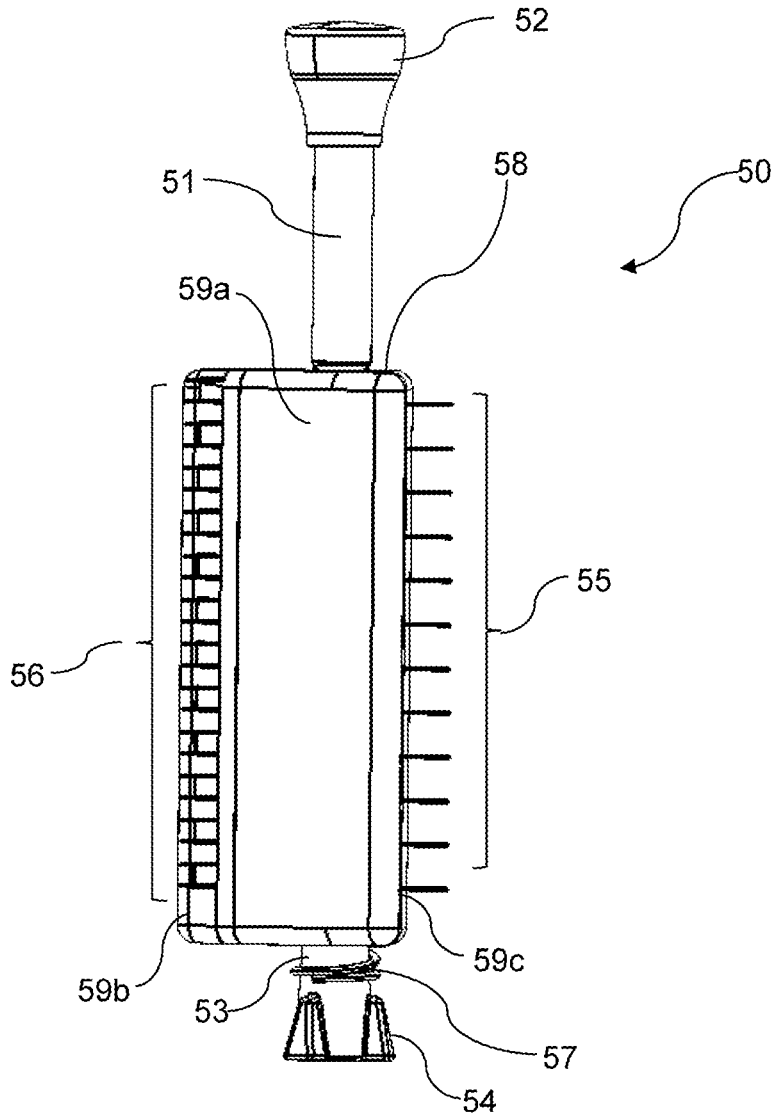
FIG. 10 is a front partially exploded view of a julienne blade holder for use with a preferred spiral cutter.

As best seen in FIG. 10, the julienne blade holder is preferably formed with an upper post 51 and a lower post 53 supporting a julienne blade body 58 between the upper post and the lower post. In the illustrated example, the julienne blade body is formed with three faces and has a triangular cross-sectional shape (when the cross section is taken in a plane perpendicular to the axis defined by the upper and lower posts). In the example of FIG. 10, two of the faces include julienne blades, including a first set of julienne blades 56 and a second set of julienne blades 55. In the illustrated example, the first set includes a greater number of blades than the second set, spaced more closely together for finer slicing. In each case as illustrated in FIG. 10, the julienne blades are positioned adjacent one side or edge of the face on the julienne blade body, adjacent an apex of the triangular cross-section. For example, one of the three sides 59*a* includes a first edge 59*b* (at the left side) and a right edge 59*c* (at the right side), with the first set of julienne blades 56 being positioned in a vertical alignment along the left side or edge. In one version, the third of the three faces on the julienne blade body has no blades so that the spiral slicer may be operated without julienne slicing. While three faces and two sets of julienne blades are illustrated and described above, in other versions of the invention additional (or fewer) sets of julienne blades may be provided.

A knob 52 is attached to the upper post 51 to allow a user to grasp the julienne body and rotate it to select a desired set of julienne blades, as described further below.

The lower post 53 terminates with a plurality of fins 54, and in one example three such fins are provided. In the illustrated version, the fins are formed only on a lower portion of the lower post, thereby leaving as section of the lower post that is generally cylindrical and without having fins. Most preferably, the fins are flared outward such that they extend radially outward farther at a lowermost portion than at the uppermost portion of the fins.

A coil spring 57 is carried on the lower post 53, mounted on the portion of the lower post between the fins 54 and the julienne blade body 58.

Figure 9:
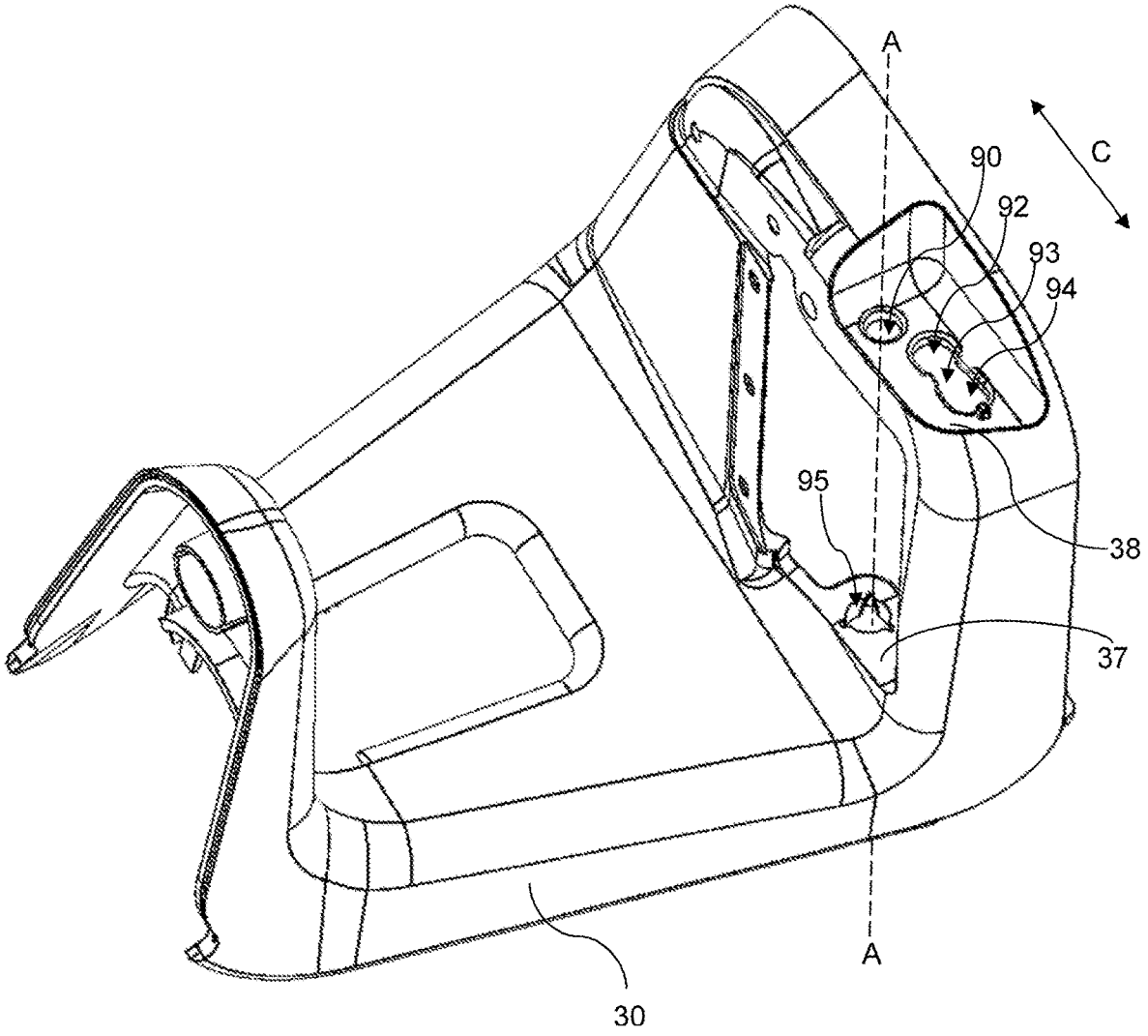
FIG. 9 is a top perspective view of a main body for use with a preferred spiral cutter.

The julienne blade holder is mounted to the main body 30 so that a user may select a desired set of julienne blades. As best seen in FIG. 9, the main body 30 includes a lower support platform 37 having a lower mount 95. The lower mount is preferably configured with a bore extending thorough the lower mount, in which the bore is generally circular in shape and with a number of radial cutouts configured to receive the fins 54 of the julienne blade holder. In the illustrated example, three radial cutouts are provided, spaced equidistant along the circumference of the lower mount. When the fins of the julienne blade holder are properly aligned, they may extend into the cutouts.

The main body further includes an upper support platform 38 having an upper mount 90. The upper mount is configured with a bore extending through the upper support platform, and as illustrated the upper mount and lower mount are preferably axially aligned along axis A. When the julienne blade holder is mounted on the main body, the upper post 51 extends through the upper mount 90 and the lower post 53 extends through the lower mount 94. The coil spring 57 is trapped between the julienne blade body 58 and the lower support platform 37, biasing the julienne blade body in an upward position, urged away from the lower support platform. Consequently, the fins 54 are receivable within the radial cutouts or slots to prevent rotation of the julienne blade body with respect to the main body 30.

When a user desires to rotate the julienne blade holder to select a different set of julienne blades, the user pushes down on the knob 52 in order to compress the coil spring and push the fins downward, out of the slots in the lower mount 95. Once the fins are cleared away from the slots the julienne blade holder may be rotated to a desired orientation. The knob can then be released upwardly to engage the fins with the slots, thereby preventing further rotation and locking the julienne blade holder in its desired position.

Figure 4:
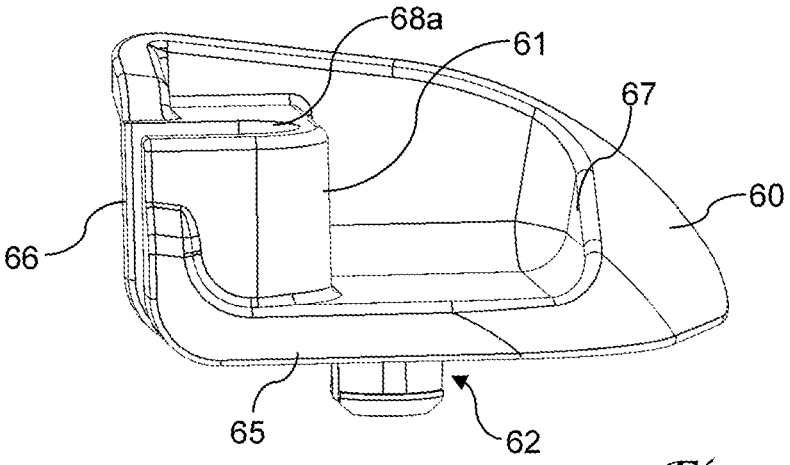
FIG. 4 is a front view of a locking cap for use with a preferred spiral cutter.
Figure 5:
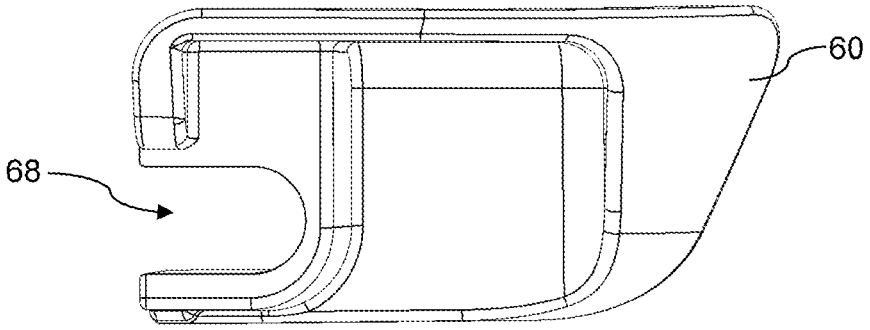
FIG. 5 is a top view of the locking cap of FIG. 4.
Figure 6:
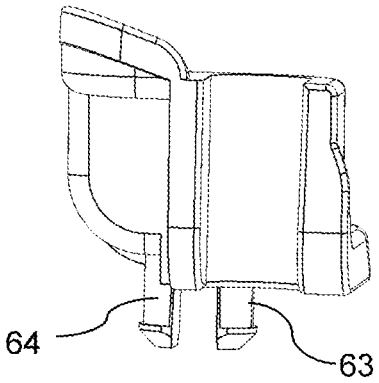
FIG. 6 is a left side view of the locking cap of FIG. 4.

One version of a preferred locking cap is shown in FIGS. 4-6. In this example, the locking cap 60 includes a generally planar horizontal lower surface 65 transitioning to a generally vertically extending first side 66. An opposite second side 67 is formed with a concavity and a raised lip configured to allow a finger of a user to grasp the locking cap in order to slide it back and forth, as described below.

The first side of the locking cap includes a recessed portion 68, which is configured to receive the upper post of the julienne blade holder, as best seen in FIG. 5. The recessed portion terminates in an upper shelf 68*a* configured to abut against the lower surface of the knob 52.

The lower surface of the locking cap includes a guide 62, which extends beneath the lower surface of the locking cap in the illustrated example. In one version, the guide is configured as a pair of adjacent legs 63, 64, each terminating with a radially outward extending foot. Each of the legs is formed to be somewhat resilient so that they may bend slightly toward one another.

Figure 8:
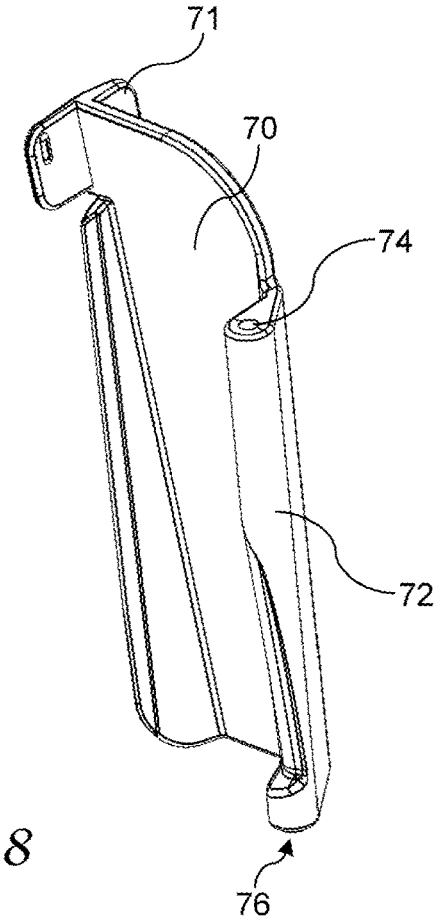
FIG. 8 is a top perspective view of a blade guard for use with a preferred spiral cutter.

When the locking cap is positioned on the main body 30, the guide 62 is inserted into locking cap track formed as an opening formed in the upper shelf 38 of the main body, as seen in FIG. 8. The locking track cap is preferably formed with an inner circular hole 92 and an outer circular hole 94, with a narrowed channel 93 joining the inner and outer holes. The guide 62 can be press-fit into one of the inner or outer holes, where it is retained within the track by the feet. The locking cap can then slide back and forth in the direction of the arrow C (see FIG. 9) to a first position in which the guide is positioned within the inner circular hole, and a second position in which the guide is positioned within the outer circular hole.

When the julienne blade holder is in position on the main body, with the upper and lower posts mounted as described above, the upper post 51 extends through the upper mount 90 with the cap spaced above the upper shelf 38. The locking cap 60 can be moved to the first position in which the upper post is positioned within the recessed portion and the cap engages the top of the locking cap. In this first position, the julienne blade holder is restricted against downward movement, thereby holding the fins on the lower post of the julienne blade holder firmly upward, locked in the channels formed in the lower mount 95. The spiral slicer can then be used with the julienne blade holder in a desired locked position.

In order to adjust the julienne blade holder, the locking cap is first moved to the second position, toward the right side of the arrow C in FIG. 9, so that the guide 62 occupies the outer hole 94. In this second position, the upper post is no longer positioned within the channel formed in the locking cap, and the julienne blade holder can then be pressed downward, compressing the spring, to free the fins from the channels in the lower mount. In this downward oriented position, the julienne blade holder can be rotated to a new desired orientation and then moved upward again under the force of the spring. The locking cap is then returned to the first position to lock the julienne blade holder in the new position.

As described above, in one version a first face of the julienne blade mount includes a first set of julienne blades, a second face includes a second set of julienne blades, and a third face includes no blades. The third face may be used as a storage position, or when spiral slicing is desired without also using julienne blades.

Figure 7:
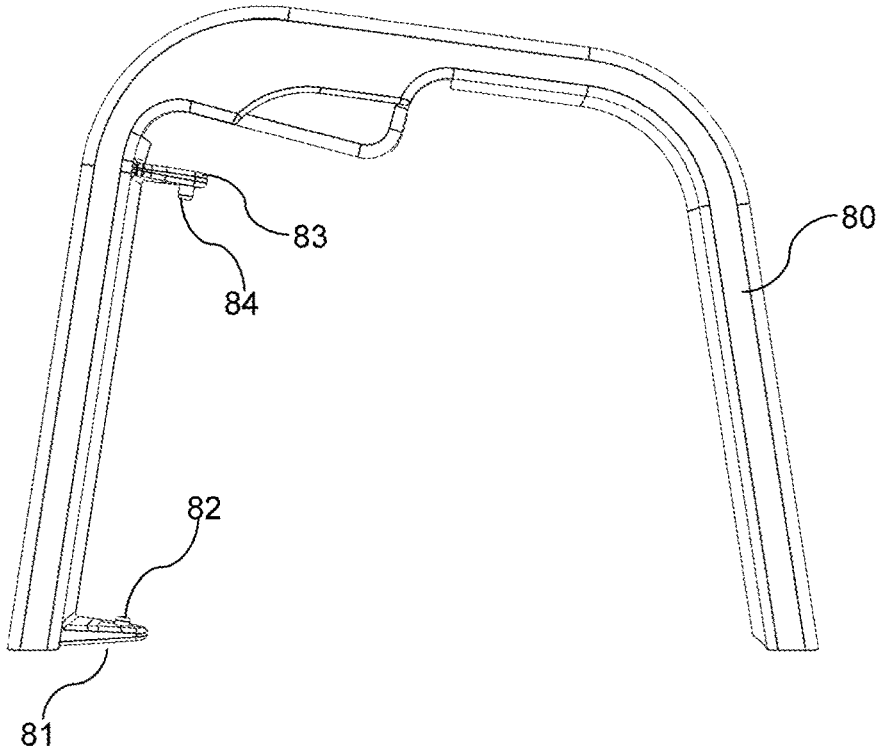
FIG. 7 is a front view of a rear frame member for use with a preferred spiral cutter.

The exposed rear side of the main body is configured to include a blade guard 70. In the illustrated example, the main body includes a rear frame 80 which may be separately attached to the main body, or integrally formed with the main body. As best seen in FIGS. 7 and 8, the rear frame includes an upper and a lower hinge formed as an upper lateral beam 83 with a downward stem 84 and a lower lateral beam 81 with an upward stem 82. The blade guard 70 includes a first edge 72 configured with an upper cavity 74 and a lower cavity 76. The blade guard is attachable to the frame in which the upper stem is inserted into the upper cavity and the lower stem is inserted into the lower cavity. It should be appreciated that the blade guard may be attached in a hinged fashion using other structures, such as the reversal of the stems and cavities. The blade guard further preferably includes a handle 71 to allow a user to grasp the guard to open or close it.

In an alternate version of the invention, such as illustrated in FIG. 1, the main body 130 may have a different shape, and may include legs 140 that are configured differently. Thus, in the illustrated example the legs are formed separately from one another and pivotally mounted to lateral surfaces of the main body.

As with the first example above, the alternate example preferably includes an axle 122 and a crank handle 120. It should be appreciated that the crank handle can be replaced with a different structure for rotating the axle and extending it into the blade.

In either version of the invention, or yet other versions, the julienne blades need not be aligned along an edge of the julienne blade holder. For example, as seen in FIG. 11, the julienne blades may be spaced apart along a face of the julienne blade holder, organized along several lines of curvature.

The blade lock in the above version or in alternate versions of the invention may also vary. For example, the blade lock 160 may move between locking and unlocking positions by rotating rather than sliding. As seen in the top view of an alternate version in FIG. 12, a blade lock 160 may rotate along an arc as represented by arc D.

Figure 13:
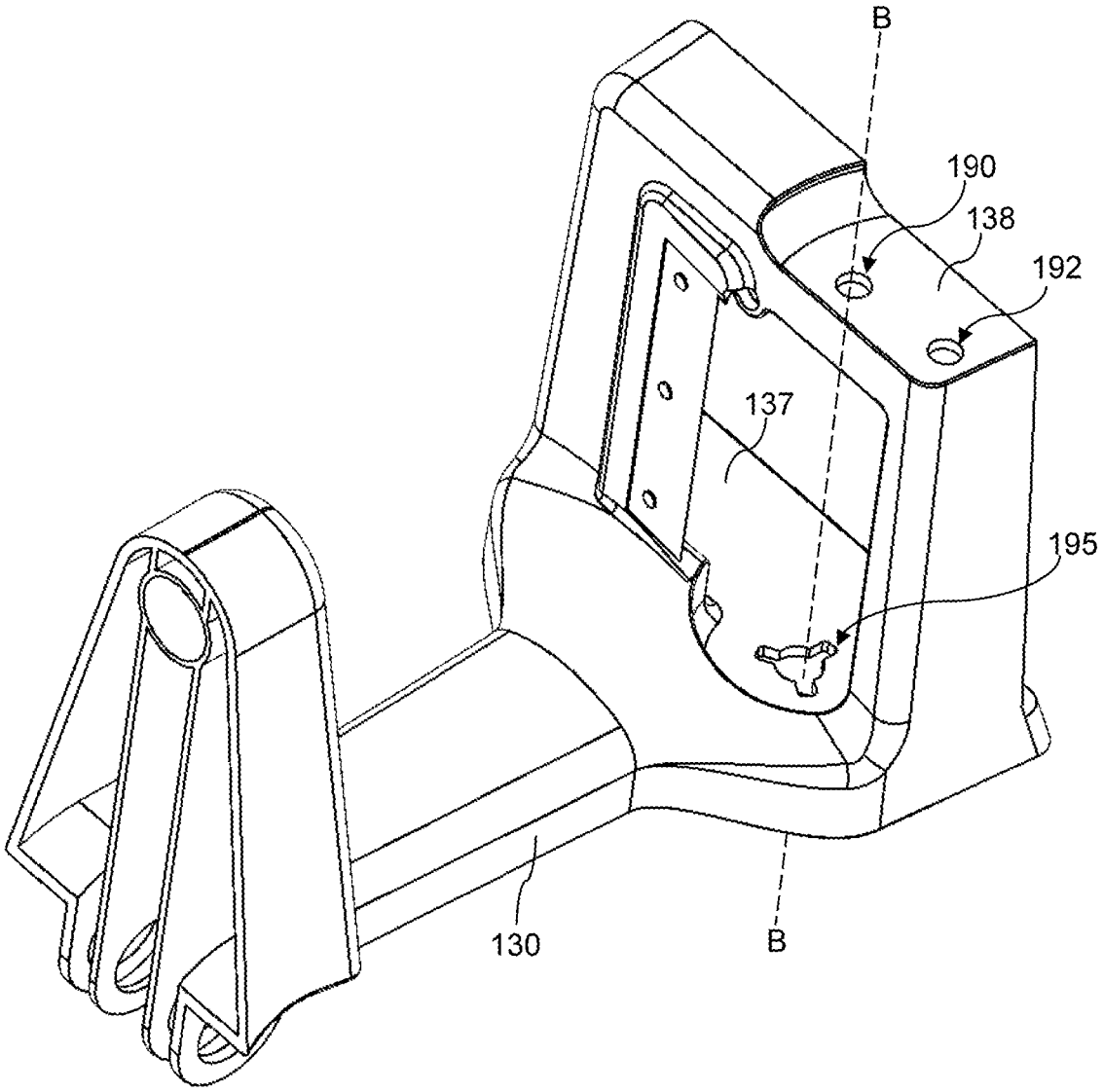
FIG. 13 is a top perspective view of the main body for use with a spiral cutter of FIG. 11.
Figure 14:
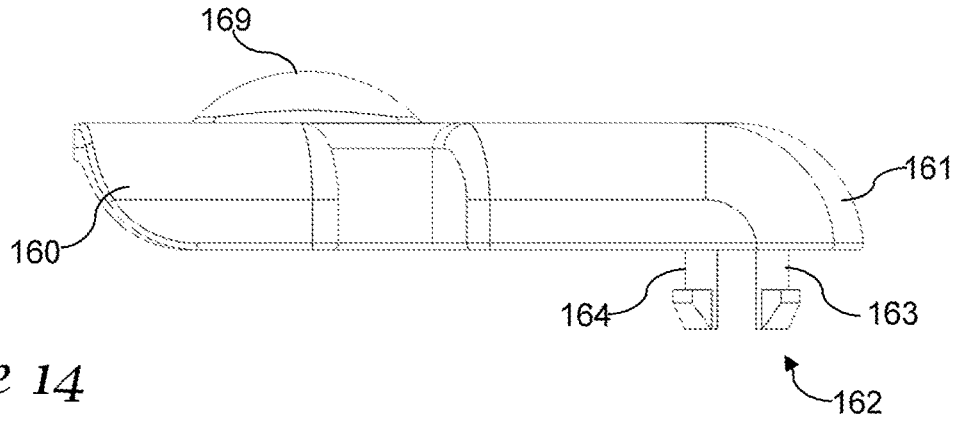
FIG. 14 is a front view of an alternate locking cap for use with a preferred spiral cutter.

In one example of such a structure, the main body 130 (see FIG. 13) may include a julienne blade holder as with the first version described above, in which the main body 130 includes an upper shelf 138 having an upper mount 190 and a lower shelf 137 with a lower mount 195. Preferably, the upper and lower mounts are axially aligned along axis B, and the lower mount includes a plurality of radial channels as described above. The upper shelf in this example includes a lock mount 192 which is formed as a single circular hole, rather than a pair of holes separated by a channel to form a track.

An alternate rotating locking cap 160 is formed with a handle 169 along an upper surface and with a guide 162. The guide is preferably formed as a pair of legs 163, 164 having radially extending feet, and in which the legs are separated by a gap and somewhat flexible toward one another under a force. Consequently, the guide may be snap-fit into the lock mount 192 and be retained in position by the feet. The guide and the lock mount are sized and configured so that the locking cap may be rotated, with the guide rotating within the lock mount.

Figure 15:
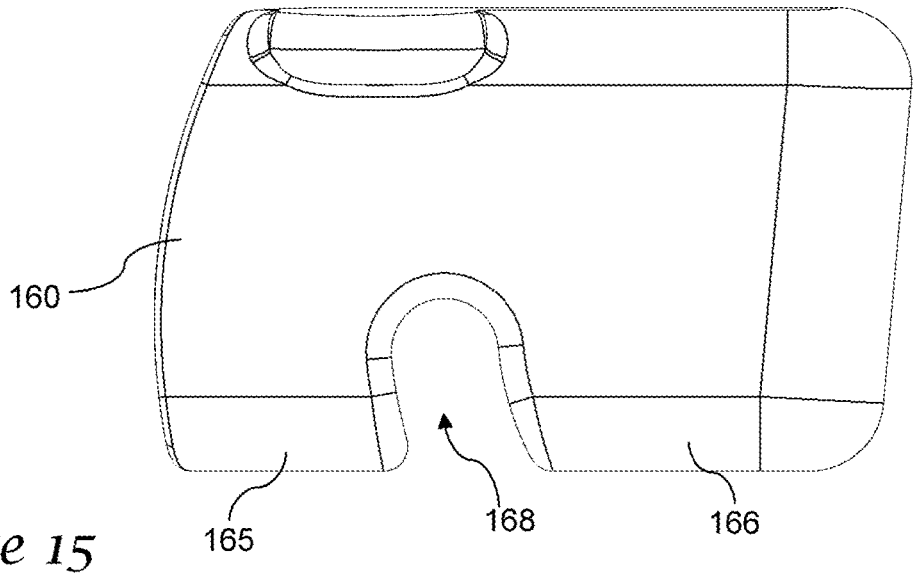
FIG. 15 is a top perspective view of the locking cap of FIG. 14.
Figure 16:
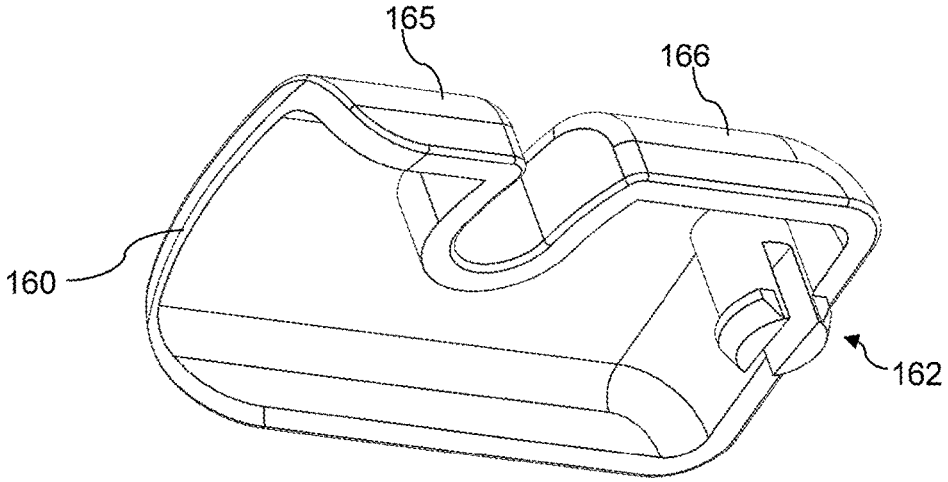
FIG. 16 is a bottom perspective view of the locking cap of FIG. 14.

The rotating locking cap 160 further includes a recessed portion, and in the illustrated example the recessed portion 168 is positioned along a front edge at an intermediate location between a first portion 165 and a second portion 166 of the locking cap. As seen in FIG. 15, preferably the locking cap is generally square or rectangular when viewed from the top, and the guide 162 is located in a corner adjacent the second portion and a first side edge 161 of the cap. The recessed portion 168 forms a channel cut into the cap, and is preferably formed along an arc or an angle with respect to the front edges of the first portion and second portion 165, 166, to receive the upper post as the locking cap is rotated.

Figure 12:
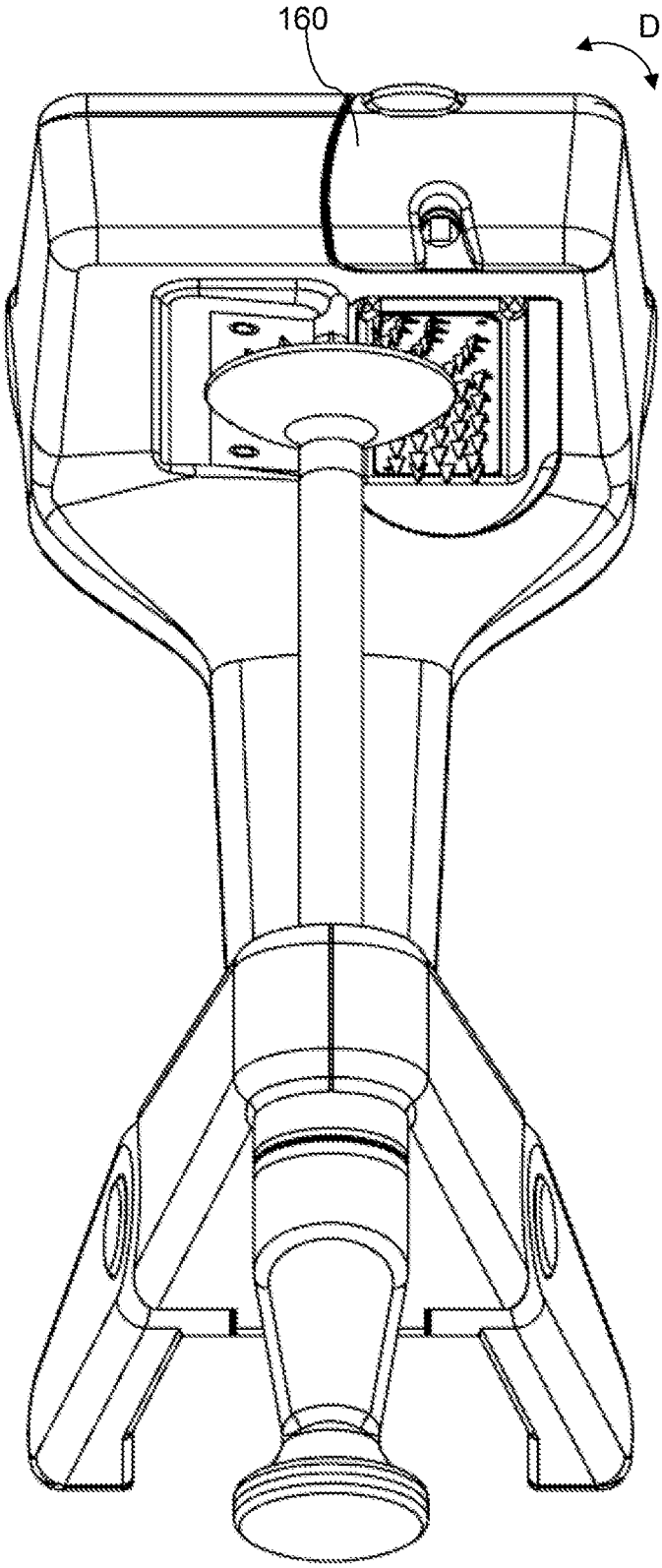
FIG. 12 is a top perspective view of the spiral cutter of FIG. 11.

When the locking cap 160 is mounted to the main body, it is movable between a first locked position and second unlocked position. In the first locked position, the locking cap is rotated to the position as seen in FIG. 12. In this position, the upper post of the julienne blade holder is received within the recessed portion 168 and the julienne blade holder is held in an upward position as described above. In order to unlock and rotate the julienne blade holder, the locking cap is rotated in a clockwise direction about an axis defined by the guide 162, along the arc D in FIG. 12, until the upper post and cap are clear from the restraint of the recessed portion. In this second unlocked position, the julienne blade holder can be pressed downward against the spring to allow it to be rotated into a desired position. The cap can then be rotated back to the locked position to allow the spiral slicer to be used.

In use, the locking cap is moved to the second position (by sliding or rotating, for example) and the julienne blade holder is rotated to its desired orientation. The locking cap is then moved to the first locking position. A vegetable or other item is attached to the holder and the axle is cranked to push the food item against the blades. The crank is further rotated as desired to allow the food item to be sliced by the main blade and, if in position, a desired set of julienne blades.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

The embodiments of the invention in which an exclusive property or privilege is claimed are defined as follows:

1. A spiral slicer, comprising:

a main body having a central body portion connecting a crank end to an opposing slicing end, the crank end and the slicing end each extending upwardly from the central body portion and defining an upper open region between the crank end and the slicing end;

a stand supporting the crank end of the main body, the stand comprising a first leg and a second leg, each of the first leg and the second leg being pivotally moveable between a retracted position and an extended position, the stand extending downwardly from the main body in the extended position;

one or more feet positioned at the slicing end of the main body and extending downwardly from the main body to support the slicing end, wherein when the first leg and the second leg are in the extended position the crank end is elevated with respect to the slicing end when the spiral slicer is resting on a horizontal surface;

a crank handle and a pusher mounted on the crank end, the pusher having one or more fins for engaging a food item, the crank handle being operable to rotate the pusher and the food item when the pusher engages the food item;

a main slicing blade attached to the slicing end of the main body and having a sharp edge extending upwardly with respect to the central portion of the main body; and a julienne blade holder mounted on the slicing end of the main body and a gap between the sharp edge of the main slicing blade and the julienne slicer, the julienne blade holder further having an upper mount positioned at a top end of the slicing end of the main body;

the julienne blade holder further having an upper post mounted to the slicing end of the main body and defining an axis of rotation for the julienne blade holder within the slicing end of the main body, the axis of rotation extending upwardly and transverse to the horizontal surface when the spiral slicer is resting on the horizontal surface, the upper post extending through the upper mount, and a knob being secured to the upper post of the julienne blade holder and positioned at the top end of the slicing end of the main body, the julienne blade holder further being axially moveable along the axis of rotation in an upward direction to enable rotation of the julienne blade holder, wherein rotation of the knob causes rotation of the julienne blade holder about the axis of rotation, the julienne blade holder having a first plurality of julienne slicing blades and a second plurality of julienne slicing blades;

the julienne blade holder further being selectively rotatable into at least a first rotational position and a second rotational position about the axis of rotation, wherein in the first rotational position the first plurality of julienne blades extends toward the crank end of the main body to encounter the food item rotated toward the main blade by the pusher, and in the second rotational position the second plurality of julienne blades extends toward the crank end of the main body to encounter the food item rotated toward the main blade by the pusher.

2. The spiral slicer of claim 1, wherein the julienne blade holder further comprises a third rotational position.

3. The spiral slicer of claim 1, wherein the julienne blade holder and the slicing end of the main body comprise complementary mating surfaces which interact to resist rotation of the julienne blade holder about the axis of rotation.

4. The spiral slicer of claim 3, wherein the julienne blade holder further comprises a first face, a second face, and a third face, the first set of julienne blades being positioned on the first face, the second set of julienne blades being positioned on the second face, and the third face being devoid of blades, and further wherein the julienne blade holder is selectively moveable to a third rotational position in which the third face is directed toward the crank end of the main body.

5. The spiral slicer of claim 4, further comprising an alignment spindle carried on the slicing end of main body adjacent the main slicing blade and adjacent the julienne blade holder.

6. The spiral slicer of claim 4, further comprising a blade guard positioned over the julienne blade holder, the julienne blade holder being positioned between the blade guard and the crank end.

7. A spiral slicer, comprising:

a main body having a central body portion connecting a crank end to an opposing slicing end, the crank end and the slicing end each extending upwardly from the central body portion;

a stand supporting the crank end of the main body, the stand being pivotally moveable between a retracted position and an extended position, the stand extending downwardly from the main body in the extended position, wherein when the stand is in the extended position the crank end is elevated with respect to the slicing end when the spiral slicer is resting on a horizontal surface;

a crank handle and a pusher mounted on the crank end, the pusher having a surface facing the slicing end of the main body for engaging a food item, the crank handle being operable to rotate the pusher and the food item when the pusher engages the food item;

a main slicing blade attached to the slicing end of the main body and having a sharp edge extending upwardly with respect to the central portion of the main body; and a julienne blade holder mounted on the slicing end of the main body and defining a gap between the sharp edge of the main slicing blade and the julienne slicer;

the julienne blade holder further having a post, the post being mounted to the slicing end of the main body and defining an axis of rotation for the julienne blade holder on the slicing end of the main body, the axis of rotation extending upwardly when the spiral slicer is resting on a horizontal surface, the post and the slicing end of the main body having complementary mating surfaces which interact to resist rotation of the julienne blade holder about the axis of rotation;

a spring being trapped between the post and the main body, wherein the spring urges the complementary mating surfaces to interact and resist rotation of the julienne blade holder about the axis of rotation, and further wherein movement of the julienne blade holder together with the post in an axial direction will disengage the complementary mating surfaces and allow rotation of the julienne blade holder about the axis of rotation;

a knob being secured to the post and extending upwardly at the slicing end, the knob being operable by a user to cause rotation of the knob and corresponding rotation of the julienne blade holder about the axis of rotation, the julienne blade holder having a first plurality of julienne slicing blades and a second plurality of julienne slicing blades;

the julienne blade holder further being selectively rotatable into at least a first rotational position and a second rotational position about the axis of rotation, wherein in the first rotational position the first plurality of julienne blades extends toward the crank end of the main body to encounter the food item rotated toward the main blade by the pusher, and in the second rotational position the second plurality of julienne blades extends toward the crank end of the main body to encounter the food item rotated toward the main blade by the pusher.

8. The spiral slicer of claim 7, wherein the pusher comprises a plurality of fins.

9. The spiral slicer of claim 7, wherein the julienne blade holder further comprises a first face, a second face, and a third face, the first set of julienne blades being positioned on the first face, the second set of julienne blades being positioned on the second face, and the third face being devoid of blades, and further wherein the julienne blade holder is selectively moveable to a third rotational position in which the third face is directed toward the crank end of the main body.

10. The spiral slicer of claim 9, further comprising an alignment spindle carried on the slicing end of main body adjacent the main slicing blade and adjacent the julienne blade holder.

11. The spiral slicer of claim 9, further comprising a blade guard positioned over the julienne blade holder, the julienne blade holder being positioned between the blade guard and the crank end.

12. The spiral slicer of claim 9, further comprising a resilient foot fixedly attached to the main body beneath the slicing end of the main body.

13. The spiral slicer of claim 9, wherein the julienne blade holder and the slicing end of the main body comprise complementary mating surfaces which interact to resist rotation of the julienne blade holder about the axis of rotation.

* * * * *